US008217321B2

(12) United States Patent
Thimm et al.

(10) Patent No.: US 8,217,321 B2
(45) Date of Patent: Jul. 10, 2012

(54) METHOD FOR GENERATING, PROCESSING AND ANALYSING A SIGNAL CORRELATED TO TEMPERATURE AND CORRESPONDING DEVICE

(75) Inventors: Wolfgang Thimm, Karlsruhe (DE); Wolfgang Wittenhagen, Bretten (DE)

(73) Assignee: E.G.O. Elektro-Geraetebau GmbH, Oberderdingen (DE)

( * ) Notice: Subject to any disclaimer, the term of this patent is extended or adjusted under 35 U.S.C. 154(b) by 438 days.

(21) Appl. No.: 12/473,868

(22) Filed: May 28, 2009

(65) Prior Publication Data

US 2009/0294433 A1 Dec. 3, 2009

Related U.S. Application Data

(63) Continuation of application No. PCT/EP2007/010405, filed on Nov. 30, 2007.

(30) Foreign Application Priority Data

Dec. 1, 2006 (DE) ..... 10 2006 057 885

(51) Int. Cl.
*H05B 1/02* (2006.01)

(52) U.S. Cl. ..... 219/494; 219/497; 219/412; 219/492; 99/332; 99/327

(58) Field of Classification Search ..... 219/492, 219/494, 497, 399, 506, 412–414; 99/325–333
See application file for complete search history.

(56) References Cited

U.S. PATENT DOCUMENTS

| | | | | |
|---|---|---|---|---|
| 4,465,228 | A | 8/1984 | Mori et al. | |
| 4,587,406 | A * | 5/1986 | Andre | 219/497 |
| 4,714,822 | A | 12/1987 | Braun et al. | |
| 5,721,419 | A | 2/1998 | Wauer et al. | |
| 6,118,104 | A * | 9/2000 | Berkcan et al. | 219/494 |
| 6,118,105 | A | 9/2000 | Berkcan et al. | |
| 6,300,606 | B1 | 10/2001 | Engelmann et al. | |
| 6,301,521 | B1 * | 10/2001 | Chen et al. | 700/207 |
| 6,462,316 | B1 | 10/2002 | Berkcan et al. | |
| 6,888,110 | B2 | 5/2005 | Baier et al. | |
| 2004/0262292 | A1 | 12/2004 | Baier et al. | |
| 2005/0247696 | A1 | 11/2005 | Clothier | |
| 2006/0289460 | A1 | 12/2006 | Thimm et al. | |

FOREIGN PATENT DOCUMENTS

| | | | |
|---|---|---|---|
| DE | 102005045875 | A1 | 3/2007 |
| EP | 1768461 | A1 | 3/2007 |
| WO | WO 9516230 | | 6/1995 |
| WO | WO 97/16943 | | 5/1997 |

OTHER PUBLICATIONS

International Search Report for PCT/EP2007/010405 dated Apr. 22, 2008.

German Search Report for German Application No. 10 2006 057 885.6.

* cited by examiner

*Primary Examiner* — Mark Paschall
(74) *Attorney, Agent, or Firm* — Alston & Bird LLP

(57) ABSTRACT

According to the invention, an improved analysis method for temperature monitoring of a hotplate (11) as a cooker with a temperature sensor (S) may be achieved by means of differentiating once over time and inverting the electronically interrogated temperature signal (T). The result of the inversion is raised to the power of ⅔ to give an output value (A). This output value is used in further processing wherein, in the second processing, the output value is compared with stored values for an output value for defined events. The recording of the output value (A) occurs for a maximum time of up to 300 seconds after starting a cooking process, advantageously 60 to 120 seconds, and then said recording and analysis is terminated.

11 Claims, 3 Drawing Sheets

METHOD FOR GENERATING, PROCESSING AND ANALYSING A SIGNAL CORRELATED TO TEMPERATURE AND CORRESPONDING DEVICE

CROSS REFERENCE TO RELATED APPLICATIONS

This application is a continuation of PCT/EP2007/010405, filed Nov. 30, 2007, which in turn claims priority to DE 10 2006 057 885.6, filed on Dec. 1, 2006, the contents of both of which are incorporated by reference.

FIELD OF THE INVENTION

The invention relates to a method for generating, processing and analyzing a temperature or a signal correlated to the temperature at a cooker or at a hob during an operating state of the cooker and to a corresponding device.

BACKGROUND OF THE INVENTION

Various methods are known for recording temperatures at a hob, both for protection of the hob plate against overheating and for performing so-called automatic cooking programs, see for example U.S. Pat. No. 6,118,105, EP 858 722 A, DE 103 29 840 A, DE 199 061 15 C or DE 103 56 432 A.

BRIEF SUMMARY OF THE INVENTION

One problem addressed by the present invention is to provide alternative methods of the type mentioned at the outset, and also a corresponding device, with which in particular a value recorded using a temperature sensor device can be provided as a starting value that can be further processed or used in the best way possible.

This problem is solved in one embodiment by a method and by a corresponding device. Advantageous and preferred embodiments of the invention are the subject matter of the further claims and are explained in greater detail in the following. Some features apply both for the methods and for the device. They are in some cases only explained once, but can however apply independently of one another both for the method and the device. The wording of the claims is made the substance of the description by express reference.

It is provided that the temperature of the cooker or of the hob, of a cooking utensil placed thereon or heated up during operation and/or of a cooking utensil content contained therein such as a foodstuff is recorded over time using a temperature sensor device. The temperature signal recorded by the temperature sensor device is differentiated once by time and then inverted and raised to the power of a number or an exponent between 0.5 and 1, advantageously between 0.6 and 0.8. From this a value is obtained as a starting value for further processing and analysis. In accordance with another embodiment of the invention, the starting value is used to deduce or determine the quantity of the cooking utensil contents. Based on this, prior determination of the boiling point is possible when the supplied heating energy is known. This can be done in different ways, preferably by measuring means in a control system.

In accordance with another embodiment of the invention, the temperature signal is, for a time before the boiling point is reached, recorded and analyzed preferably long, but with certainty shortly before the boiling point is reached, for example in the case of standard power outputs in the range from about 1200 W to 4000 W, for a period of up to about 300 seconds after the start of the cooking process or the start of heating. Since the water quantity can be advantageously determined in this way, it is for example possible, as previously stated, to avoid excessive temperatures or to better control certain cooking programs or automatic processes. This information is advantageously available during the cooking process before the boiling point is reached and it can be very helpful for further analysis even at an early stage in the cooking process. Subsequent further analysis is possible, for example, for precise determination of the boiling point. However, the aforementioned determination of the water quantity is then already completed. The calculation method and further possibilities to do so are described in DE 10 2005 045875.0 of the applicant, the substance of which is here made the substance of the present patent application by express reference.

Expressed as formulas, the previously described method means that the starting value A(t) is formed as found in Eq. 1 below.

$$A(t') = \left(\frac{\Delta t(t')}{\Delta T(t')}\right)c = const. \qquad \text{Equation 1}$$

with the variable c being positive, constant and selected from the interval 0.5 to 1 or less than 1, advantageously from the interval 0.6 to 0.8. The time intervals $\Delta x(t')=x(t\mathbf{1})-x(t\mathbf{2})$ are selected long enough not to come into conflict with the noise from the measured values. This would otherwise, under unfavorable circumstances, create so much noise around the starting value that a control unit would be very highly prone to faults. T(t') corresponds here to the signal of the temperature sensor and t(t') corresponds to the time during the measurement.

The temperature signal is advantageously analyzed in a time window of 50 to 200 seconds after the start of the cooking process. Analysis is particularly advantageous in a time window of about 60 to 120 seconds, with a heating power of more than 1500 W in an induction heater. This results in a relatively fast analysis, i.e. in a relatively short time or shortly after the start of the cooking process. Further process steps can thus have access to and make use of this analysis relatively quickly.

If a radiator is used for heating and operated in cycles, it is possible that the $\Delta t/\Delta T$ slope on which the starting value is based is negative. In this case, the amount in brackets is used. In addition, the prefixed sign of the value inside the brackets can be incorporated separately into the equation. In view of this, the prefixed sign of the starting value can be understood as the prefixed sign that would result for the case of c=1.

It should be pointed out here that for the starting value such minor changes are very noticeable due to the fact that the temperature change is in the denominator of the starting value. This applies in particular in those cases in which the temperature changes are only very minor.

In the framework of the invention, it became evident that in the manner mentioned above, a very readily analyzable curve is obtained by processing, in accordance with the invention, of the temperature signal recorded in the relatively short time period, and above all considerably before the boiling point is reached. This curve has characteristic properties and is very well suited for further analysis. The quantity of the cooking utensil contents is advantageously deduced or determined in accordance with the invention from the starting value, where the point in time at which the boiling point is reached can be approximately predetermined from this when the heating energy supplied by the electric cooker is known. This can be, for example, used for adjustment of a further boiling point detection process. In this way, the time that the boiling point is reached can be approximately predetermined in a particularly advantageous way and before the boiling point is reached the supplied heating energy can be reduced to prevent boiling of the cooking utensil contents if this is required. This can be a part of a selected cooking program.

The exponent is advantageously about ⅔, and particularly advantageously precisely ⅔. In the framework of the invention, it became evident that with this exponent an almost linear curve and hence a particularly readily processable and analyzable starting value are obtained. Formally, the value ⅔ is obtained from a consideration of the dynamic development of temperature signals. The effect that a change in the temperature of the cooked material is not directly reflected at a sensor, for example in the vicinity of the heating conductor, is therefore taken into account.

For electronic recording of the time curve of the temperature signal, various temperature sensors and corresponding measuring arrangements are suitable and are known to the person skilled in the art.

In an embodiment of the invention, the time curve of the required heating power is additionally or further monitored during the entire operation. In this way, it can be additionally detected whether a rise or fall in the temperature matches the time curve of the heating power or whether there could be an error in the temperature recording. If, for example, a rise in the temperature is ascertained at a time when no heating power is being supplied, this can be evaluated as an error in the temperature recording. This can be displayed to an operator. In addition, this cooking area of the hob can be switched off.

In a further embodiment, the cooling down of the temperature sensor while a lower power is being supplied can be evaluated. This permits a better analysis behavior to be achieved. A signal of this type can for example be achieved by a deliberate power reduction during operation of an induction heater, in particular when turning down "instant operation" with power outputs exceeding 2500 W, by cyclic operation of a radiator or by a reduction of the gas quantity in a gas heater.

It can be provided that cooling down during cyclic operation of a heater operated in cycles on the one hand, and cooling down as a consequence of reducing the power to the value "zero" on the other hand, are treated with separate calculation methods. The distinction allows the calculation to be adapted. It is however deemed more advantageous when the power is supplied continuously.

The absolute values of the temperature sensor can also be incorporated into the analysis. This applies in particular for a comparison with predetermined standard values.

As a general principle, the method described in this application is not dependent on the heater type and can be transposed from the aforementioned induction or radiation heaters to any heater types, for example thin-film or thick-film heater elements or tubular heaters. Furthermore, the method can be used for gas burners in which the supplied energy can be ascertained from the supplied gas quantity. The method is also transposable to electric appliances, for example to a baking oven or steam cooker.

These and further features are shown not only in the claims, but also in the description and in the drawings, where the individual features can each be implemented singly or severally in the form of sub-combinations in one embodiment of the invention and in other fields, and represent versions that are advantageous and protectable per se, for which protection is claimed here. The sub-division of the application into intermediate headings and individual sections does not restrict the general validity of the statements made thereunder.

BRIEF DESCRIPTION OF THE DRAWINGS

Embodiments of the invention are shown diagrammatically in the drawings and are explained in more detail in the following. The drawings show in.

DETAILED DESCRIPTION OF THE EMBODIMENTS

Figure 1:
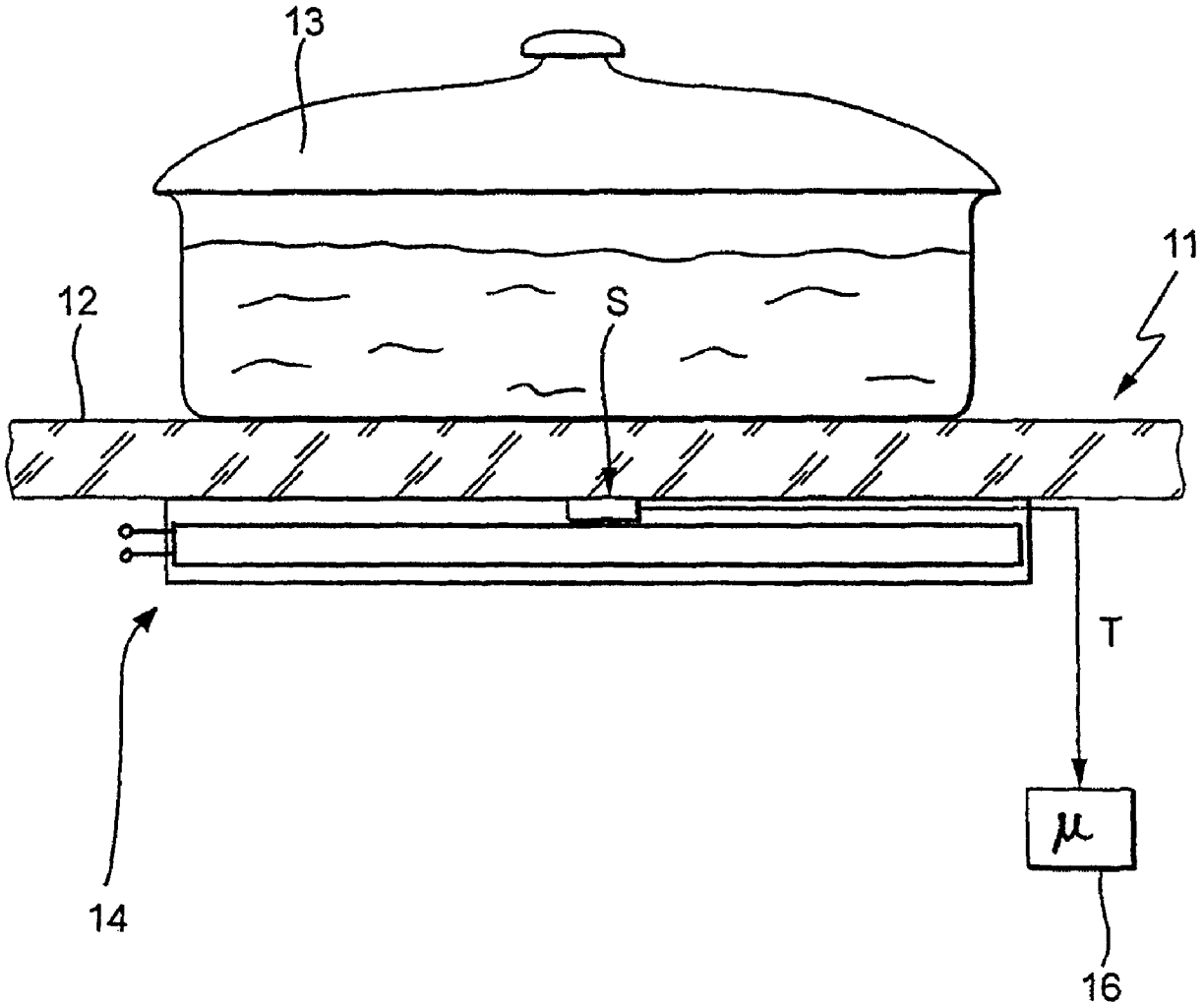
FIG. 1 a sectional view through a hob with an induction heater and a temperature sensor.

FIG. 1 shows a hob 11 as an electric cooker. It has a hob plate 12 underneath which a standard induction heating device is arranged as an induction heater 14. A cooking utensil 13 or a cooking pot is placed on the hob plate 12 above the induction heater 14 in order to heat up or boil the contents. A temperature sensor S is arranged on the underside of the hob plate 12 in the area above the induction heater 14. This can be a normal standard Pt1100 on a thick-film basis. In an alternative embodiment, it can be a tungsten sensor or an optically measuring sensor, in particular a so-called thermopile with sensitivity in a suitable wavelength range. The temperature sensor S passes the temperature T or a corresponding temperature signal to a control unit 16.

The temperature sensor S can be polled electronically via the control unit 16. This means therefore that the temperature signal T is present in the control unit 16 and can be further processed. This further processing is performed in the specified manner by differentiating the temperature signal T by time. This result is inverted and the result of the inversion is raised to the power of ⅔. The result is a starting value A1 that is used for further analysis activities and/or the performance of a cooking program or the like. It is also advantageous because it has a largely linear curve. Changes can be particularly easy to recognize from this.

If in the case of the hob 11 characteristic temperature curves are now recorded, and the curves thereby obtained of the starting value ascertained as described above are stored in the control unit 16 or in an associated memory, not shown, the starting value A ascertained during operation can be compared with it. If it is possible to recognise, based on the current curve of the starting value during a certain cooking process on the hob, a known pattern from the memory, or if it corresponds to a known pattern, the control unit 16 can analyse the result.

Possibilities for using the control unit 16 to perform a cooking program, emit warning signals or the like, or emit other signals that are known to the person skilled in the art, in particular also from the aforementioned documents of the prior art. To that extent, they do not need to be dealt with in further detail here.

Advantageously, the control unit 16 also monitors the power supply to the induction heater 14. It is thus possible to run a reasonableness check with regard to the generated temperature curve or to the recorded temperature level at the temperature sensor S by recording of the time curve of the supplied electrical energy. If for example at a certain point in time no heating power or only a very low power is generated by the induction heater 14, while the temperature at the temperature sensor S rises, an error state must be present. This applies in particular when the temperature at the temperature sensor S is so high that it can only be generated by operation of the induction heater 14 and not by, for example, placing a still very hot cooking utensil on the hob plate 12 above the temperature sensor S. It is then possible here to emit a warning signal or in some circumstances to switch off the induction heater 14 or even the entire hob 11. In this case, there is an error either in the induction heater 14, in the control unit 16 or at the temperature sensor S. Each of these error sources is relatively serious, for which reason shutdown should follow.

The system shown in FIG. 1 represents together with the cooking utensil 13 placed on it the system whose heating capacity Cp can be calculated in the manner stated. This is then compared with the same system without the cooking utensil 13 placed on it, i.e. practically an empty cooking area.

Figure 2:
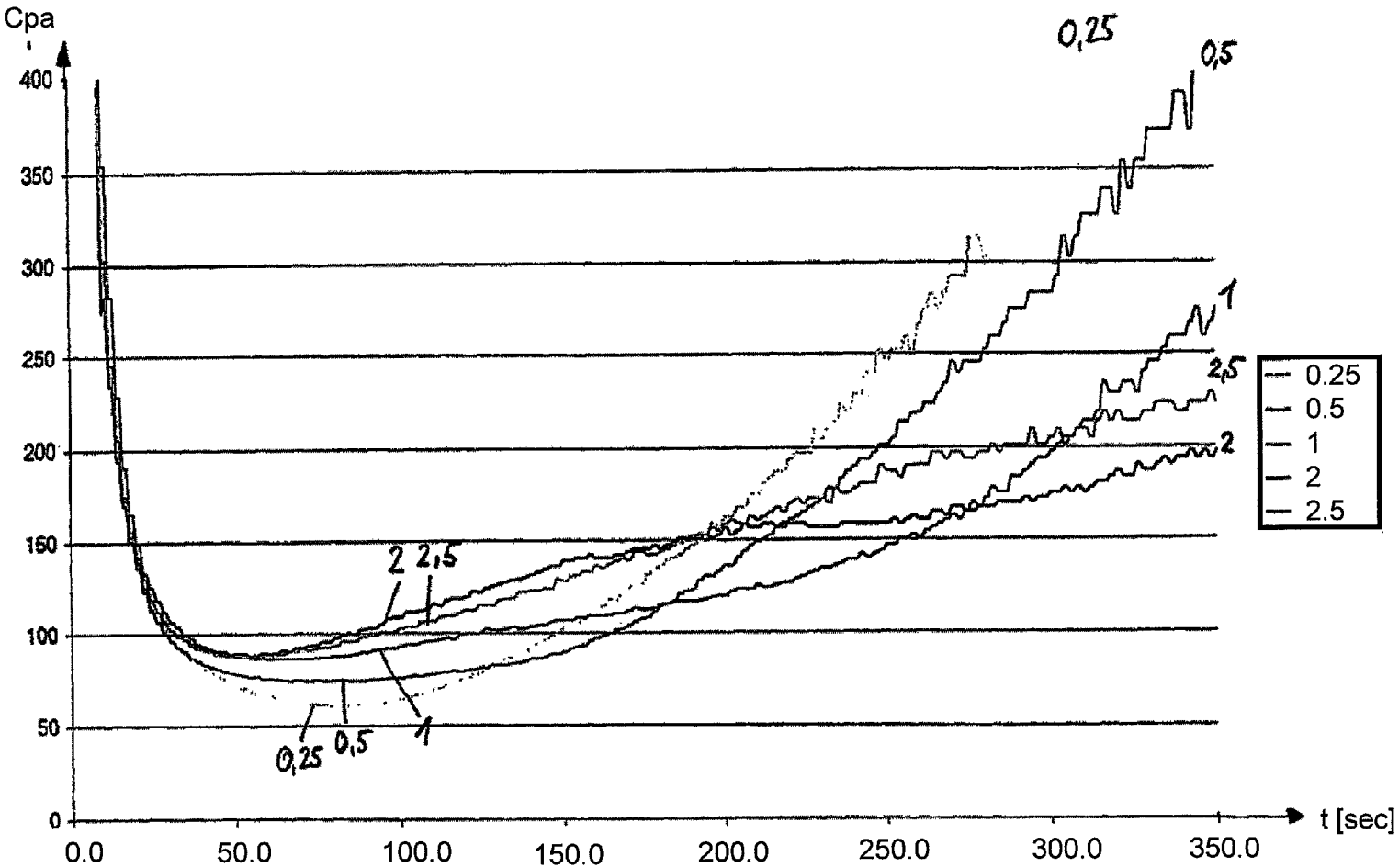
FIG. 2 a diagram for the development of the heating capacity Cp over time for approx. 300 seconds with various filling quantities in a first cooking vessel, and FIG. 3 a view corresponding to FIG. 2 with a second cooking vessel.

FIG. 2 shows the time curve of the starting value or the heating capacity recorded using an arrangement according to FIG. 1 with a first pot or cooking vessel. The quantity of water in the pot is varied here, with 0.25 liters, 0.5 liters, 1 liters, 2 liters, and 2.5 liters. The temperature for these values is recorded using the temperature sensor S underneath the glass ceramic plate 12. The supplied power was more than 1500 W.

It can be seen that shortly after the start of recording of the values for Cp the values from 0.25 liters to 2 liters are clearly distinguishable. The curve for 2.5 liters runs between those for 1 liter and 2 liters. A slightly restricted distinguishability only however impairs the accuracy of the method to a minor extent, since the difference is not particularly large here, nor in the existing quantity, and a rough determination of the quantity in this range is already very advantageous.

It can be seen that the five curves can be distinguished to some extent in the time range between 50 seconds and about 130 seconds. For a certain time phase between about 130 seconds and 300 seconds, they again converge, until they start to become similarly distinct after about 300 seconds. From here however, the values rise very steeply. Furthermore, up to this point in time five minutes have already passed, and in the framework of the invention it is regarded as particularly advantageous when the values are available considerably earlier than that. Hence the previously mentioned range between about 50 seconds and 130 seconds is regarded as particularly favorable for an analysis.

Figure 3:
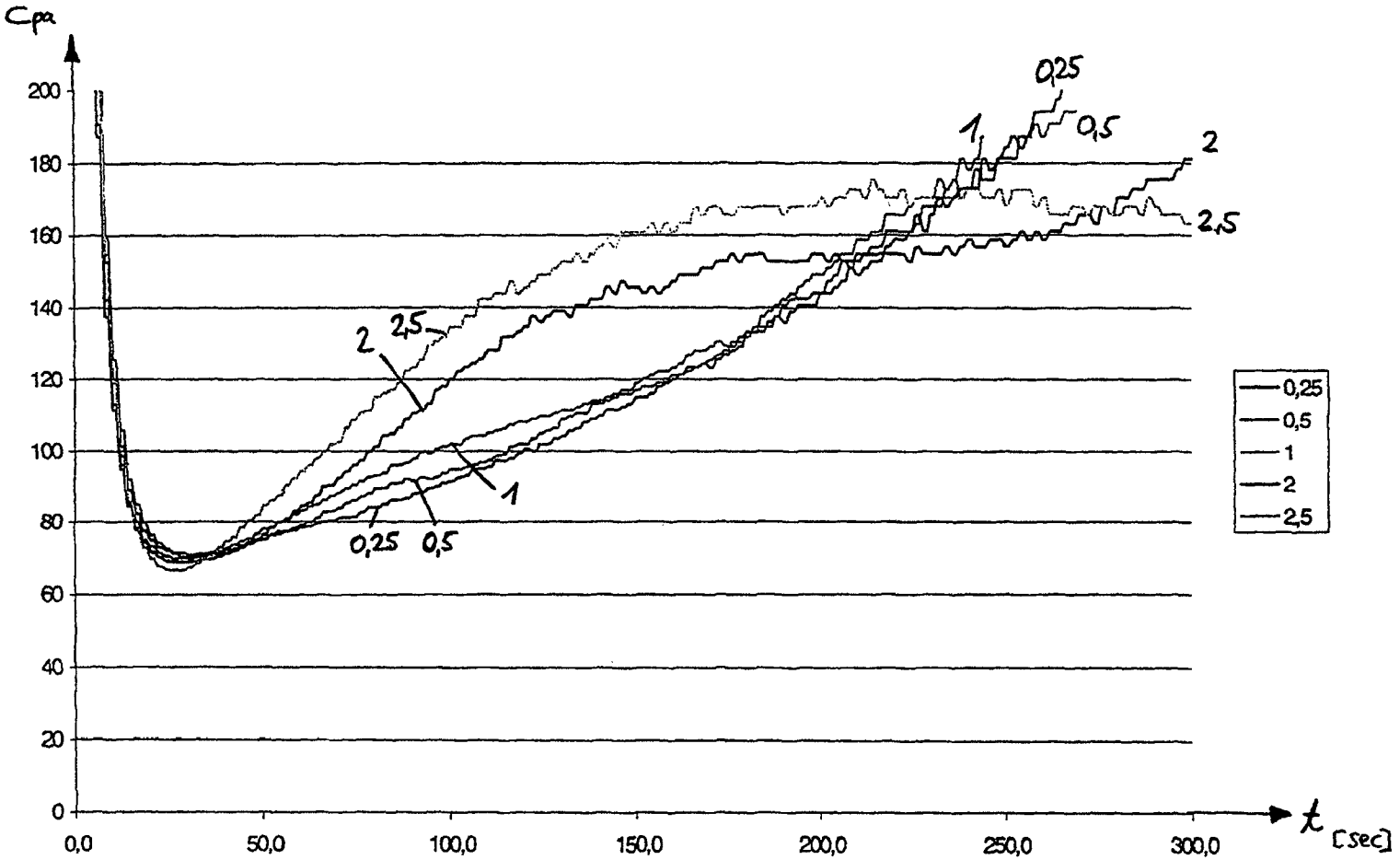

FIG. 3 shows the same sequence, however with another second cooking vessel 13. It can be seen here how, in approximately the same time range as before, the five curves for the different quantities of water in the cooking vessel can be readily distinguished and are here too separated appropriately to the quantities, i.e., quantity determination can work very well. Up to a time from about 250 to 300 seconds, the curves again widely differ. With longer periods, they would diverge again, similar to FIG. 2 and again be readily distinguishable, however with the same above restrictions or drawbacks, above all due to the late point in time.

It can be seen from the curve developments in FIG. 2 and FIG. 3 that the curves for the heating capacity Cp ascertained on the basis of the recorded temperature can be distinguished, even in time intervals that are brief in accordance with the invention, after the start of a cooking process or heating operation, for example after one to two minutes.

It is of course necessary now for the control unit 16 to know the curve developments or a kind of reference curve development. To do so, it is conceivable to record certain reference curves once and hence store them in the control unit. This can be advantageously done by the factory during manufacture. Alternatively, it can be attempted to deduce them from the time behavior of the values for the heating capacity Cp, in particular in the period before about 120 seconds, in particular due to the drop in the curve and the achieved absolute values. A further possible method can be for one operator to store reference curves from specific cooking vessels used.

Mathematical Representation

To make clear the ideas described above, this section is intended to briefly set out again the train of thought using mathematical formulas. For greater clarity of the representation, the case described is exponent=1, without loss of generality.

The following relationships are known:

$$E=P*\Delta t \tag{1}$$

where E=energy, P=power and t=time, $$Cp=\frac{\Delta E}{\Delta T} \tag{2}$$

where Cp is the heating capacity and ΔT a temperature change. For Cp, the formula Cp=Cp_pot+Cp_water+Cp_cooking area applies in a good approximation. Of these factors, water has the highest specific heating capacity and it can be assumed as an approximation for large water quantities that Cp is approximately Cp_water. According to the definition of the specific heating capacity, what applies then is $$Cp=cp_\text{specific_H2O}*m \tag{3}$$

where m is the water quantity. With a known cp_specific_$H_2O$, it follows that the water quantity can be determined if Cp is measured according to $$m=\frac{Cp}{\text{cp_spezifisch_}H_2O}. \tag{3a}$$

Within the framework of the idea, the power P and the temperature T are determined at a time t1 relatively soon after switch-on. Δt1 is the time from the switch-on time to t1. ΔT relates to the temperature difference proceeding from the starting temperature. It then follows that $$Cp(t1)=\frac{P(t1)*\Delta t1}{\Delta T(t1)} \tag{4}$$

If however a certain temperature increase ΔT2 is required, e.g. 80° C. starting from about 20° C. starting temperature, the analogous relationship applies for this. A changeover of the above relationship can be used to calculate the time Δt2 at which the temperature increase ΔT2 will be achieved:

$$\Delta t2=\frac{Cp(t1)*\Delta T2}{P(t1)} \tag{5}$$

As long as the water is not yet boiling, the heating capacity does not substantially change and equation (4) can be incorporated into equation (5) to obtain $$\Delta t2=\frac{\Delta t1*\Delta T2}{\Delta T(t1)}. \tag{6}$$

The particular feature of this equation is that the "boiling point" Δt2 only depends on factors already known at the time t1. The "boiling point" can therefore already be calculated early on using equation (6) as soon as a largely stable value for Cp(t1) has been ascertained.

A generalization with a power P' which is changed at the time t1 can be achieved simply. It then follows that $$\Delta t2 = \frac{P(t1) * \Delta t1 * \Delta T2}{\Delta T(t1) * P'} \quad (7)$$

A measurement at different times t can of course be performed to check the stability of the result.

The invention claimed is:

1. A method for generating, processing and analyzing a temperature or a signal correlated to a temperature at an electric cooker during an operating state of said cooker, comprising:

measuring said temperature of said cooker, via a temperature sensor device;

providing said temperature to a control unit which records said temperature;

differentiating, via the control unit, said temperature by time to obtain a result;

inverting, via the control unit, said result;

raising, via the control unit, the inverted result to the power of an exponent between 0.5 and 1 to obtain a starting value, wherein said starting value is taken as a basis for further processing and analysis; and utilizing, via the control unit, said starting value to determine a quantity of contents of a cooking utensil placed on said cooker, where a point in time at which a boiling point is reached is predetermined from this when heating energy supplied by said electric cooker is known for adjustment of a further boiling point detection process.

2. The method according to claim 1, wherein a time that said boiling point is reached is predetermined and before said boiling point is reached, heating energy supplied to said electric cooker is reduced to prevent boiling of said contents of the cooking utensil.

3. The method according to claim 1, wherein an amount of said heating energy supplied is recorded using said control unit by recording a heating power over time.

4. The method according to claim 3, wherein a temperature signal from said temperature sensor device is provided to a control unit.

5. A method for generating, processing and analyzing a temperature or a signal correlated to a temperature at an electric cooker in the operating state of said cooker;

measuring said temperature of said cooker, via a temperature sensor device;

providing said temperature to a control unit that records said temperature;

differentiating, via the control unit, said temperature by time to obtain a result;

inverting, via the control unit, said result;

raising, via the control unit, the inverted result to the power of an exponent between 0.5 and 1 to obtain a starting value, wherein the starting value is taken as a basis for further processing and analysis;

recording, via the control unit, said temperature signal for a time up to a maximum of 300 seconds after start of said cooking process.

6. The method according to claim 5, wherein said temperature signal is analyzed in a time window of 50 to 200 seconds after said start of said cooking process.

7. The method according to claim 5, wherein said temperature signal is analyzed in a time window of about 60 to 120 seconds after said start of said cooking process.

8. The method according to claim 5, wherein said exponent is between 0.6 and 0.8.

9. The method according to claim 8, wherein said exponent is about ⅔.

10. A device for processing and analyzing a temperature or a signal correlated to a temperature at a cooker, during operation of said cooker, the device comprising:

a temperature sensor device configured to measure said temperature of said cooker, said device comprising a control unit configured to:

record a time curve of a temperature signal (T) of a temperature sensor device (S); and receive, via a microprocessor, the temperature signal of the temperature sensor device, the microprocessor is configured to:

perform a differentiation of the temperature signal over time;

invert a result of the differentiation and subsequently raise said result of said inversion to a power of an exponent between 0.5 and 1.0 for a starting value for further processing and analysis of said starting value; and record said temperature signal for a time up to a maximum of 300 seconds after start of said cooking process.

11. The device according to claim 10, wherein said exponent is between 0.6 and 0.8.

* * * * *